US011846177B2

(12) United States Patent
James et al.

(10) Patent No.: US 11,846,177 B2
(45) Date of Patent: Dec. 19, 2023

(54) ADJUSTABLE LENGTH SENSOR ASSEMBLY FOR WELLHEAD

(71) Applicant: Halliburton Energy Services, Inc., Houston, TX (US)

(72) Inventors: Paul Gregory James, Spring, TX (US); Ravi Sharad Vayeda, Spring, TX (US); Sean Michael Gum, Kingwood, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 183 days.

(21) Appl. No.: 17/025,354

(22) Filed: Sep. 18, 2020

(65) Prior Publication Data

US 2022/0090488 A1 Mar. 24, 2022

(51) Int. Cl.
*E21B 47/07* (2012.01)
*E21B 17/02* (2006.01)

(52) U.S. Cl.
CPC ..... *E21B 47/07* (2020.05); *E21B 17/023* (2013.01)

(58) Field of Classification Search
CPC ..... E21B 47/06; E21B 47/07; E21B 34/025; E21B 33/068; E21B 33/072
See application file for complete search history.

(56) References Cited

U.S. PATENT DOCUMENTS 2,002,532 A 5/1935 Flatley
2,234,056 A 3/1941 Moore
3,589,192 A 6/1971 Sabovik
3,765,242 A 10/1973 Bailleu
4,963,194 A 10/1990 Mele
5,287,879 A * 2/1994 Leggett ..... E21B 33/062 137/246.22
6,752,397 B2 6/2004 Kohli et al.
7,219,736 B1 5/2007 Levy
D576,477 S 9/2008 Levy
7,465,086 B1 12/2008 Foreman, Jr.
7,784,838 B2 8/2010 Levy
8,037,933 B1 10/2011 Levy
2013/0027215 A1* 1/2013 Kleppa ..... E21B 47/06 340/853.2

(Continued)

FOREIGN PATENT DOCUMENTS

CA 974083 9/1975

*Primary Examiner* — Christopher J Sebesta
(74) *Attorney, Agent, or Firm* — Scott Richardson; Parker Justiss, P.C.

(57) ABSTRACT

This disclosure provides a sensor assembly. The sensor assembly, in one aspect, includes a flange housing, the flange housing including a mating surface for engaging a wellhead and an opposing surface, an interior cavity extending into the flange housing from the mating surface, and an exterior cavity extending into the flange housing from the opposing surface. The sensor assembly, according to this aspect, further includes a connector in sealed engagement with the flange housing proximate the exterior cavity, and a control line extending into the interior cavity through the connector. The sensor assembly, according to this aspect, further includes a sensor coupled to an exposed end of the control line proximate the interior cavity, the control line slidable within the connector, the exterior cavity and the interior cavity to move the sensor between a retracted position and an expanded position to accommodate different thickness wellheads.

20 Claims, 7 Drawing Sheets

(56) References Cited

U.S. PATENT DOCUMENTS

| | | | | |
|---|---|---|---|---|
| 2015/0275653 | A1* | 10/2015 | Ringgenberg | E21B 47/09 166/336 |
| 2018/0163520 | A1* | 6/2018 | Navar | E21B 33/04 |

* cited by examiner

ADJUSTABLE LENGTH SENSOR ASSEMBLY FOR WELLHEAD

BACKGROUND

As the worldwide demand for hydrocarbon fuel has increased, there has been increasing activity in offshore oil exploration and production. Reserves of oil known to exist in the offshore areas have steadily increased, and thus an increasing percentage of the world's production is from these offshore areas.

Offshore production wells, along with many onshore production wells, include a wellhead assembly and/or Christmas tree at their surface for controlling the well. The wellhead assembly typically supports casing which extends into the well. Tubing extends through the casing for producing the formation fluids. The wellhead assembly is a tubular body having a bore extending vertically through it with outlets leading from the bore through the sidewall. Valves are mounted in the bore and to the outlets of the wellhead assembly for providing access to the tubing as well as directing the produced fluid out to a flow line. Additionally, sensors may be positioned in a flange of the wellhead and/or Christmas tree for monitoring various conditions (e.g., temperature and/or pressure) of the formation fluids.

DETAILED DESCRIPTION

Figure 1:
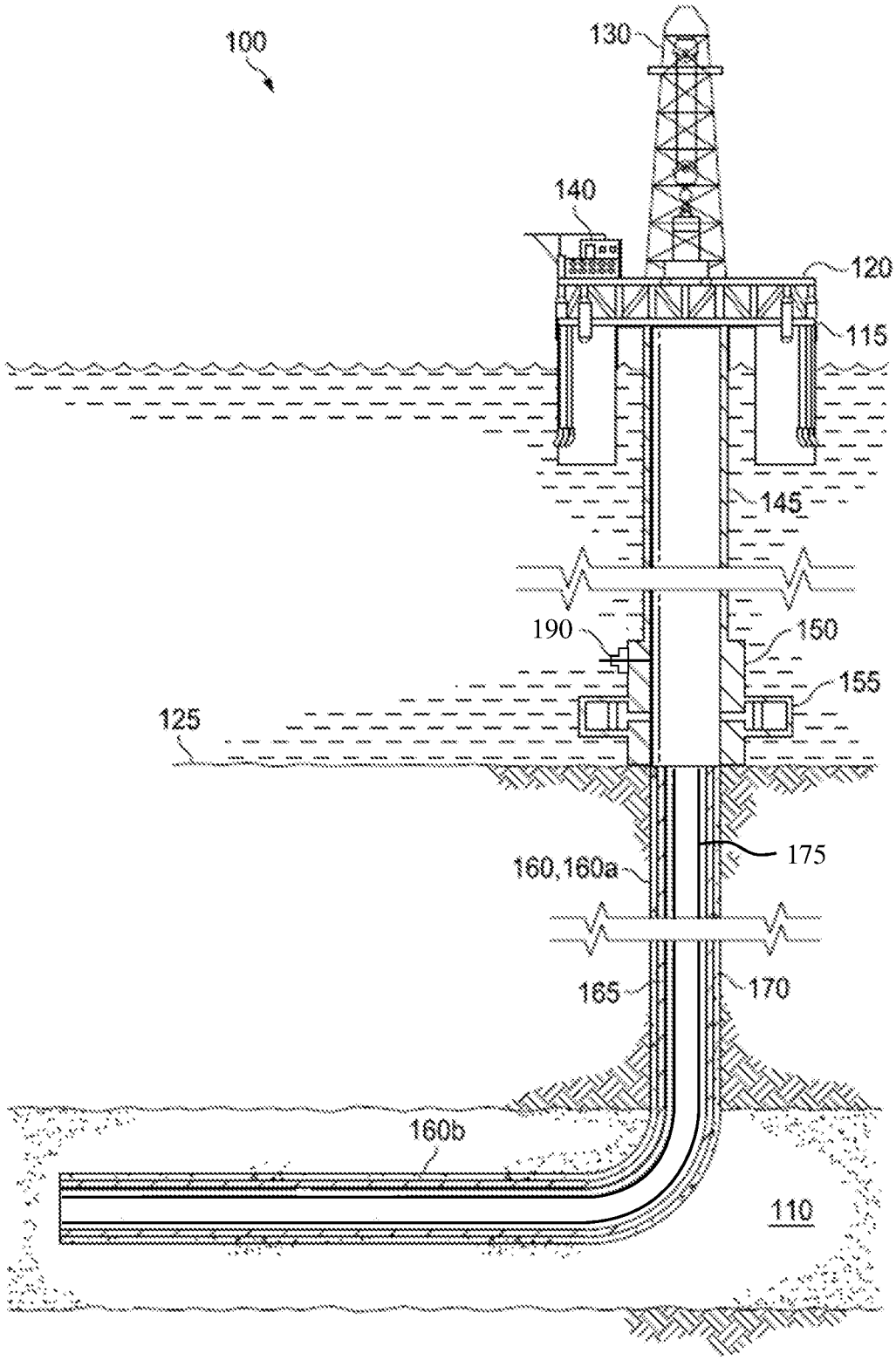
FIG. 1 illustrates a well system including a sensor assembly designed, manufactured and/or operated according to the present disclosure.

In order to measure accurate temperature and/or pressure of wellbore fluid exiting a wellhead, a sensor has to extend into the flow-path of the wellbore fluid a specific distance. Without this specific distance, the measurements from the sensor may be inaccurate. Unfortunately, the specific distance varies greatly with the thickness of the wellhead and flange housing that the sensor is to be installed within. Moreover, the thickness of the wellhead and flange housing varies greatly with its design and/or pressure rating. As the sensor length is traditionally fixed, a sensor that is designed to work for one wellhead and flange housing thickness will not work for another different wellhead and flange housing thickness. The present disclosure has recognized that an adjustable length sensor eliminates many of the problems associated with the variable thickness wellheads and flange housings.

In the drawings and descriptions that follow, like parts are typically marked throughout the specification and drawings with the same reference numerals, respectively. The drawn figures are not necessarily to scale. Certain features of the disclosure may be shown exaggerated in scale or in somewhat schematic form and some details of certain elements may not be shown in the interest of clarity and conciseness. The present disclosure may be implemented in embodiments of different forms.

Specific embodiments are described in detail and are shown in the drawings, with the understanding that the present disclosure is to be considered an exemplification of the principles of the disclosure, and is not intended to limit the disclosure to that illustrated and described herein. It is to be fully recognized that the different teachings of the embodiments discussed herein may be employed separately or in any suitable combination to produce desired results.

Unless otherwise specified, use of the terms "connect," "engage," "couple," "attach," or any other like term describing an interaction between elements is not meant to limit the interaction to direct interaction between the elements and may also include indirect interaction between the elements described. Use of any one or more of the foregoing terms shall not be construed as denoting positions along a perfectly vertical axis. In some instances, a part near the end of the well can be horizontal or even slightly directed upwards. In such instances, the terms "up," "upper," "upward," "uphole," "upstream," or other like terms shall be used to represent the toward the surface end of a well. Unless otherwise specified, use of the term "subterranean formation" shall be construed as encompassing both areas below exposed earth and areas below earth covered by water such as ocean or fresh water.

Referring initially to FIG. 1, schematically illustrated is a well system 100, including a sensor assembly 190 designed, manufactured and/or operated according to the present disclosure. The well system 100 of FIG. 1, without limitation, includes a semi-submersible platform 115 having a deck 120 positioned over an oil and gas formation 110, which in this embodiment is located below sea floor 125. The platform 115, in the illustrated embodiment, may include a hoisting apparatus/derrick 130 for raising and lowering various oil and gas components, such as work string, production tubing, etc. The well system 100 illustrated in FIG. 1 may additionally include a control system 140 located on the deck 120, or elsewhere. The control system 140, in one embodiment, may be used to control various different aspects of the well system 100, including taking readings from the sensor assembly 190 (e.g., wired or wireless readings).

A subsea conduit 145 extends from the platform 115 to a wellhead installation 150, which may include one or more subsea blow-out preventers 155. A wellbore 160 extends through the various earth strata including formation 110. In the embodiment of FIG. 1, wellbore casing 165 is cemented within wellbore 160 by cement 170, and includes production tubing 175 therein. In the illustrated embodiment, wellbore 160 has an initial, generally vertical portion 160*a* and a lower, generally deviated portion 160*b*, which is illustrated as being horizontal. It should be noted by those skilled in the art, however, that the sensor assembly 190 of the present disclosure is equally well-suited for use in other well configurations including, but not limited to, inclined wells, wells with restrictions, non-deviated wells and the like. Moreover, while the wellbore 160 is positioned below the sea floor 125 in the illustrated embodiment of FIG. 1, those skilled in the art understand that the principles of the present disclosure are equally as applicable to other subterranean formations, including those encompassing both areas below exposed earth and areas below earth covered by water such as ocean or fresh water.

In accordance with one embodiment of the disclosure, the sensor assembly 190 includes a flange housing, the flange housing operable to engage a wellhead installation 150. The flange housing, in accordance with this embodiment, may include a mating surface for engaging a wellhead and an opposing surface. The flange housing, in accordance with this embodiment, may additionally include an interior cavity extending into the flange housing from the mating surface, and an exterior cavity extending into the flange housing from the opposing surface. The sensor assembly 190, in accordance with this embodiment, may further include a connector in sealed engagement with the flange housing proximate the exterior cavity, a control line extending through the connector and into the interior cavity, and a sensor coupled to the control line proximate the interior cavity. In accordance with this embodiment of the disclosure, the control line is slidable within the connector, the exterior cavity and the interior cavity to move the sensor between a retracted position and an expanded position, for example to accommodate different thickness wellheads and flange housings.

Figure 2:
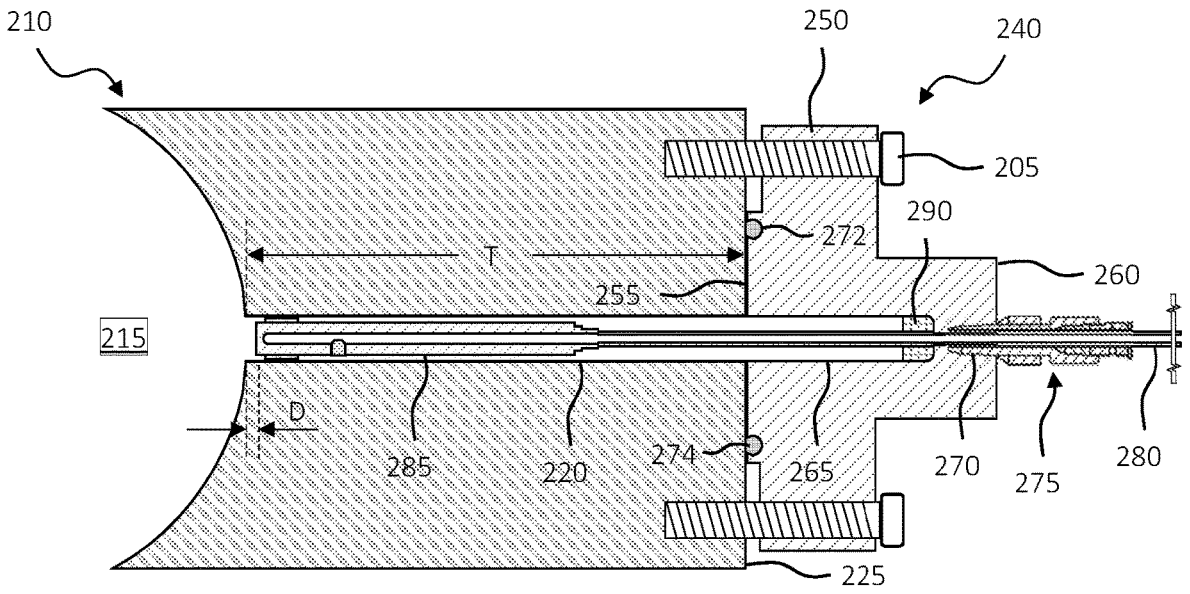
FIG. 2 illustrates a wellhead coupled with a sensor assembly designed, manufactured and operated according to one or more embodiments of the disclosure.

Referring now to FIG. 2, schematically illustrated is a wellhead 210 coupled with a sensor assembly 240 designed, manufactured and operated according to one or more embodiments of the disclosure. In the illustrated embodiment, one or more fasteners 205 couple the sensor assembly 240 with the wellhead 210. The wellhead 210, in the illustrated embodiment, includes a flow passageway 215 extending there through, the flow passageway 215 generally in fluid communication with production tubing (e.g., similar to the production tubing 175 illustrated in FIG. 1). The flow passageway 215 permits passage of wellbore fluids between the production tubing and other oil and gas components uphole thereof. The wellhead 210 additionally includes a sensor receptacle 220 that extends between the flow passageway 215 and an exterior wall 225 of the wellhead 210. The wellhead 210, in accordance with one or more embodiments of the disclosure, may comprise any flange associated with a wellhead installation, including a flange associated with a Christmas tree in one embodiment. Accordingly, the term wellhead as used herein is intended to include a Christmas tree.

In the illustrated embodiment, the wellhead 210 has a wellhead thickness (T). As indicated above, the wellhead thickness (T) may vary on a well by well basis. In certain embodiments, the wellhead thickness (T) is at least 50 mm. In certain other embodiments, the wellhead thickness (T) ranges anywhere from 75 mm to 400 mm, with one particular embodiment employing a wellhead thickness (T) range from 90 mm to 210 mm. While certain wellhead thicknesses (T) have been discussed with regard to the wellhead 210, the present disclosure should not be limited to any specific wellhead thicknesses (T), and in fact the sensor assembly 240 of the present disclosure is generally designed to accommodate any such wellhead thicknesses (T).

The sensor assembly 240, in the illustrated embodiment, includes a flange housing 250. The flange housing 250, in certain embodiments, is a steel flange housing. Other flange housing 250 materials, however, remain within the scope of the disclosure. The flange housing 250 includes a mating surface 255 (e.g., for engaging the exterior wall 225 of the wellhead 210). The flange housing 250, in the illustrated embodiment, additionally includes an opposing surface 260.

In accordance with one embodiment of the disclosure, the flange housing 250 includes an interior cavity 265 extending into the flange housing 250 from the mating surface 255. In accordance with this embodiment, the flange housing 250 additionally includes an exterior cavity 270 extending into the flange housing 250 from the opposing surface 260. In the illustrated embodiment, the interior cavity 265 is a larger cavity than the exterior cavity 270. Nevertheless, in certain embodiments, the interior cavity 265 and the exterior cavity 270 are the same size, and thus may comprise a single cavity. In certain embodiments, such as the embodiment of FIG. 2, a centerline of the interior cavity 265 and a centerline of the exterior cavity 270 are substantially aligned with one another. For example, the centerline of the interior cavity 265 and the centerline of the exterior cavity 270 may be within 5% of perfectly aligned with one another and remain within the scope of at least one embodiment of the disclosure.

The flange housing 250, in the illustrated embodiment, additionally includes a seal groove 272 positioned in the mating surface 255. The seal groove 272, in this embodiment, circumscribes the interior cavity 265. In the illustrated embodiment of FIG. 2, a circumferential seal 274 is located within the seal groove 272. The circumferential seal 274, in this embodiment, may be an O-ring or another sealing member (e.g., compressible sealing member) and remain within the scope of the disclosure. The seal groove 272 having the circumferential seal 274 therein, helps fluidly isolate the interior cavity 265 from an exterior of the flange housing 250 when the flange housing 250 is coupled to the wellhead 210.

The sensor assembly 240, in one or more embodiments consistent with the disclosure, includes a connector 275 in sealed engagement with the flange housing 250. In the embodiment shown, the connector 275 is in sealed engagement with the flange housing 250 proximate the exterior cavity 270. In fact, in the embodiment of FIG. 2, the connector 275 extends partially within the exterior cavity 270. The connector 275, in at least one embodiment, is a full metal jacket (FMJ) type high pressure hydraulic line connector. In one embodiment, the connector 275 provides one or more seals between the surface of the exterior cavity 275 and a control line 280 extending there through. For example, the connector 275 could provide redundant metal-to-metal seals between the exterior cavity 275 and the control line 280, and thus act as a high pressure seal to prevent high-pressure leakage paths along the control line 280.

In the illustrated embodiment, the control line 280 has a sensor 285 coupled to an end thereof, and as shown extends through the connector 275 and into the interior cavity 265. The control line 280, in at least one embodiment, comprises a tubing encapsulate conductor (TEC) type control line. In accordance with this embodiment, the control line 280 includes an electrical conductor surrounded by a jacket. Nevertheless, other types of control lines are within the scope of the disclosure. The sensor 285, in accordance with the disclosure, is operable to measure one or more different parameters of the wellbore fluid traversing through the wellhead 210. For example, the sensor 285 in at least one embodiment is a temperature sensor or a pressure sensor, among other possible sensors.

In the illustrated embodiment of FIG. 2, the sensor 285 has been positioned a distance (D) from the flow passageway 215 in the wellhead 210. The distance (D) may vary greatly and remain within the purview of the disclosure. In one example, the distance (D) is effectively zero. In other embodiments, the distance (D) is a few mm or more. For example, the distance (D) in one embodiment ranges from 3 mm to 20 mm, with one particular embodiment employing a distance (D) ranging from 4 mm to 10 mm. In certain other embodiments, not shown, the distance (D) is a negative value, and thus the sensor 285 extends into the flow passageway 215.

The sensor assembly 240, in accordance with one or more embodiments of the disclosure, may additionally include a seal member 290 surrounding the control line 280. The seal member 290, in the illustrated embodiment, is configured to prevent high-pressure leakage paths along the control line 280 while allowing the control line 280 to slide within the connector 275, the exterior cavity 270 and the interior cavity 265. In certain embodiments, the control line 280 slides within the connector 275, the exterior cavity 270 and the interior cavity 265 prior to engagement of connector 275 with the flange housing 250. In this embodiment, the length of the control line 280 and position of the sensor 285 are fixed after engagement of the connector 275 with the flange housing 250. In certain other embodiments, the control line 280 slides within the connector 275, the exterior cavity 270 and the interior cavity 265 after engagement of connector 275 with the flange housing 250. In certain embodiments, the seal member 290 is located within the interior cavity 265, as shown in FIG. 2. In other embodiments, the seal member 290 is located within the exterior cavity 270. In yet other embodiments, the seal member 290 forms at least a portion of the connector 275. For example, the previously discussed metal-to-metal seal of the connector 275 may be used as the seal member 290.

New to the present disclosure, the control line 280 is slidable within the connector 275, the exterior cavity 270 and the interior cavity 265 (e.g., prior to engagement of connector 275 with the flange housing 250). Accordingly, the sensor 285 that is attached to the control line 280 may move between a retracted position (e.g., a position wherein the sensor 285 is located more proximate the opposing surface 260 of the flange housing 250) and an expanded position (e.g., a position wherein the sensor 285 is located more distal the opposing surface 260 of the flange housing 250). Accordingly, the slidability of the control line 280 allows the sensor 285 to be moved to accommodate different wellhead thicknesses (T). While many sensor assembly designs linearly fix the control line 280 (e.g., including the sensor 285) relative to the flange housing 250, such is not the case in the instant disclosure. In fact, certain embodiments of the present disclosure employ no welds to linearly fix the control line 280 (e.g., including the sensor 285) relative to the flange housing 250.

Figure 3A:
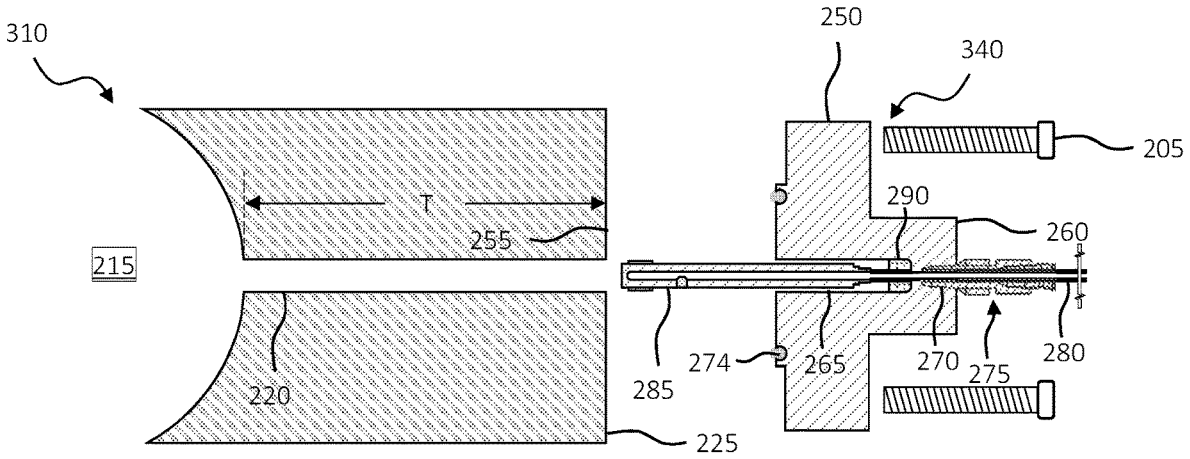
FIGS. 3A through 3C illustrate a wellhead and a sensor assembly at various different stages of coupling, as might be used for measuring one or more properties of wellbore fluid exiting a wellbore in accordance with the disclosure.
Figure 3B:
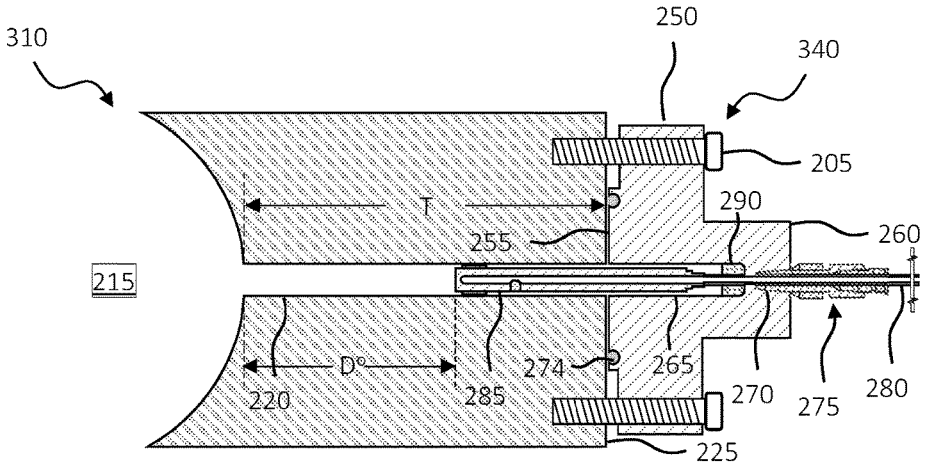
Figure 3C:
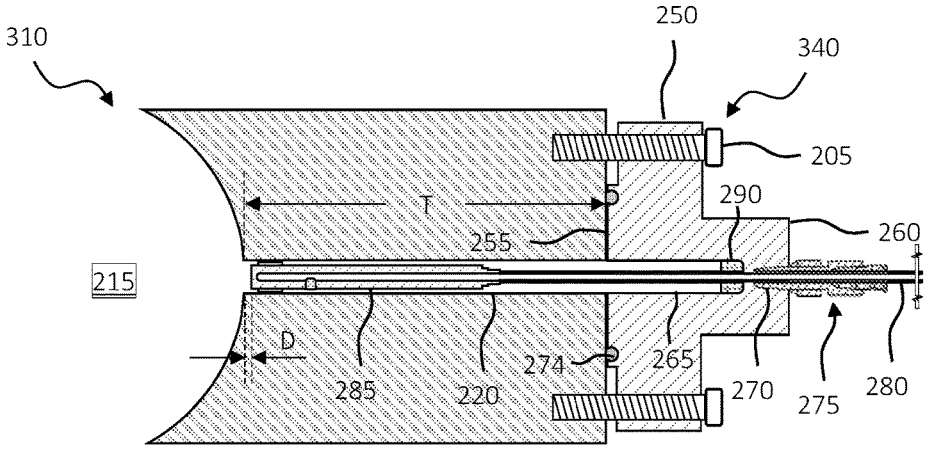

Turning to FIGS. 3A through 3C, illustrated are a wellhead 310 and a sensor assembly 340 at various different stages of coupling, as might be used for measuring one or more properties of wellbore fluid exiting a wellbore in accordance with the disclosure. The wellhead 310 and the sensor assembly 340 illustrated in FIGS. 3A through 3C are similar in many respect to the wellhead 210 and the sensor assembly 240 illustrated and described with respect to FIG. 2. Accordingly, like reference numbers have been used to indicate similar, if not identical, features.

With initial reference to FIG. 3A, the wellhead 310 and the sensor assembly 340 are separated from one another. Similarly, the fasteners 205 are removed from the sensor assembly 340. In the illustrated embodiment of FIG. 3A, the control line 280 is positioned in a retracted position (e.g., a position wherein the sensor 285 is located more proximate the opposing surface 260 of the flange housing 250) and is ready to move to an expanded position. While the control line 280 is positioned in the retracted position in the embodiment of FIG. 3A, in other embodiments the control line 280 might be positioned in the expanded position (e.g., a position wherein the sensor 285 is located more distal the opposing surface 260 of the flange housing 250) and be ready to move to the retracted position. Namely, it is the ability of the control line 280 to expand and retract to accommodate different wellhead thicknesses (T) and flange housing thicknesses, and not the specific direction of movement, that sets the sensor assembly 280 of the present disclosure apart from competing devices.

The sensor assembly 340 may be assembled and proof tested prior to being coupled to the wellhead 310. Such proof testing ensures that no high-pressure leakage paths exist along the control line 280, while the control line 280 remains configured to slide within the connector 275. The one or more seal members 290 are helpful in preventing the aforementioned high-pressure leakage path. Again, the one or more seal members 290 may be positioned at various locations along the control line 280 and still remain within the scope of the disclosure.

Turning to FIG. 3B, the wellhead 310 and the sensor assembly 340 have been coupled together, and in the embodiment of FIG. 3B secured to one another using the fasteners 205. The fasteners 205 compress the circumferential seal 274 against the exterior wall 225 of the wellhead 310 to form a seal between the wellhead 310 and the sensor assembly 340. Again, the circumferential seal 274 circumscribes the inner cavity 220 such that any wellbore fluid passing through the sensor receptacle 220 will not leak into the surrounding environment between the exterior wall 225 of the wellhead 310 and the mating surface 255 of the flange housing 250.

Typically, the wellhead 310 is fixed to a surface, and thus the sensor assembly 340 is brought toward the wellhead 310. Nevertheless, the present disclosure should not be limited to any specific movement of the wellhead 310 relative to the sensor assembly 340. In the illustrated embodiment of FIG. 3B, the sensor 285 remains within the retracted position as it extends at least partially into the sensor receptacle 220. Given that the sensor 285 remains within the retracted position, the sensor 285 is positioned a distance (D°) from the flow passageway 215 in the wellhead 310. Said distance (D°) is generally not tailored for the wellhead thickness (T). In certain instances, the distance (D°) is too far away from the flow passageway 215 to get proper readings from the sensor 285, and in other instances the distance (D°) is too close to the flow passageway 215 to get proper readings from the sensor 285. Notwithstanding, in accordance with the present disclosure, the control line 280 and the sensor 285 may slide within the connector 275, the exterior cavity 270 and the interior cavity 265 to properly place the sensor 285 relative to the flow passageway 215 (e.g., prior to engagement of connector 275 with the flange housing 250).

Turning to FIG. 3C, the control line 280 and sensor 285 have been moved between the retracted position illustrated in FIG. 3B and the expanded position illustrated in FIG. 3C to properly place the sensor 285 relative to the flow passageway 215. In the illustrated embodiment, the sensor 285 is now positioned a proper distance (D) from the flow passageway 215 in the wellhead 310. Accordingly, the sensor 285 is positioned at an acceptable, if not preferred, distance (D) such that the sensor 285 may take accurate measurements of the wellbore fluid flowing through the flow passageway 215.

In the embodiment of FIGS. 3A through 3C, the control line 280 and the sensor 285 have been moved from the distance (Do) to the distance (D) after the sensor assembly 340 has been coupled to the wellhead 310. In certain embodiments, such movement occurs while wellbore fluid is flowing through the flow passageway 215, and thus while the sensor assembly 340 is under high pressure. Accordingly, such movement may occur in the field (e.g., prior to engagement of connector 275 with the flange housing 250). In certain other embodiments, however, the movement occurs prior to the sensor assembly 340 being coupled to the wellhead 310. In such embodiments, the wellhead thickness (T) and the optimal distance (D) of the sensor 285 from the flow passageway 215 may be calculated. Thereafter, the control line 280 and the sensor 285 may be moved between the retracted position illustrated in FIG. 3B and the expanded position illustrated in FIG. 3C while the sensor 285 remains outside of the wellhead 310. This second embodiment may be conducted in the field, or alternatively may be conducted at the shop or another location. In the second embodiment, the flange housing 250 of the sensor assembly 340 would be attached to the wellhead 310 after the sliding movement of the control line 280 and the sensor 285 relative to the connector 275.

Figure 4:
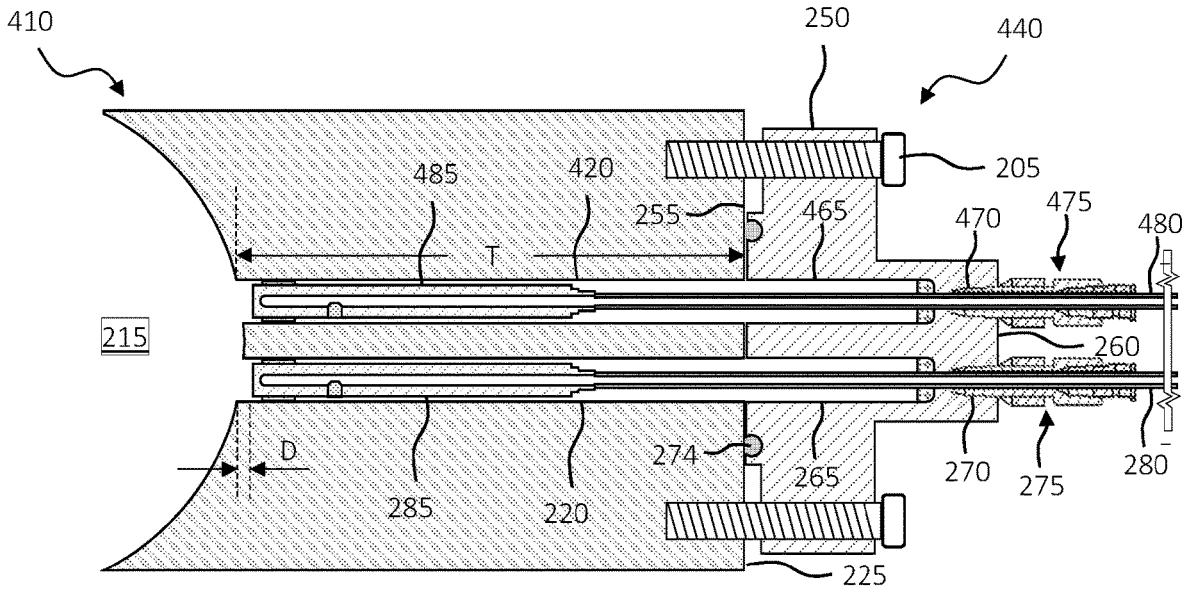
FIG. 4 illustrates an alternative embodiment of wellhead and sensor assembly designed, manufactured and operated according to another embodiment of the disclosure.

Turning to FIG. 4, illustrated is an alternative embodiment of wellhead 410 and sensor assembly 440 designed, manufactured and operated according to another embodiment of the disclosure. The wellhead 410 and the sensor assembly 440 illustrated in FIG. 4 are similar in many respect to the wellhead 210 and the sensor assembly 240 illustrated and described with respect to FIG. 2. Accordingly, like reference numbers have been used to indicate similar, if not identical, features. The wellhead 410 differs, for the most part, from the wellhead 210, in that the wellhead 410 includes a second sensor receptacle 420.

The sensor assembly 440 differs, for the most part, from the sensor assembly 240, in that the flange housing 250 includes a second interior cavity 465 extending into the flange housing 250 from the mating surface 255, and a second exterior cavity 470 extending into the flange housing 250 from the opposing surface 260. The sensor assembly 440 additionally includes a second connector 475 in sealed engagement with the flange housing 250 proximate the second exterior cavity 470, and a second control line 480 extending through the second connector 475 and into the second interior cavity 465. In addition, the sensor assembly 440 includes a second sensor 485 coupled to the second control line 480 proximate the second interior cavity 465. The second control line 480, in accordance with the disclosure, is slidable within the second connector 475, the second exterior cavity 470 and the second interior cavity 465 to move the second sensor 485 between a second retracted position and a second expanded position to accommodate different thickness wellheads.

The first and second control lines 280, 480, and their associated first and second sensors 285, 485, in one or more embodiments are operable to slide independent of one another. In other embodiments, they are operable to slide lock step with one another. The first and second sensors 285, 485, in the illustrated embodiment may be redundant sensors, such that they measure the same wellbore fluid parameter. In other embodiments, the first and second sensors 285, 485 measure different wellbore fluid parameters from one another.

Figure 5:
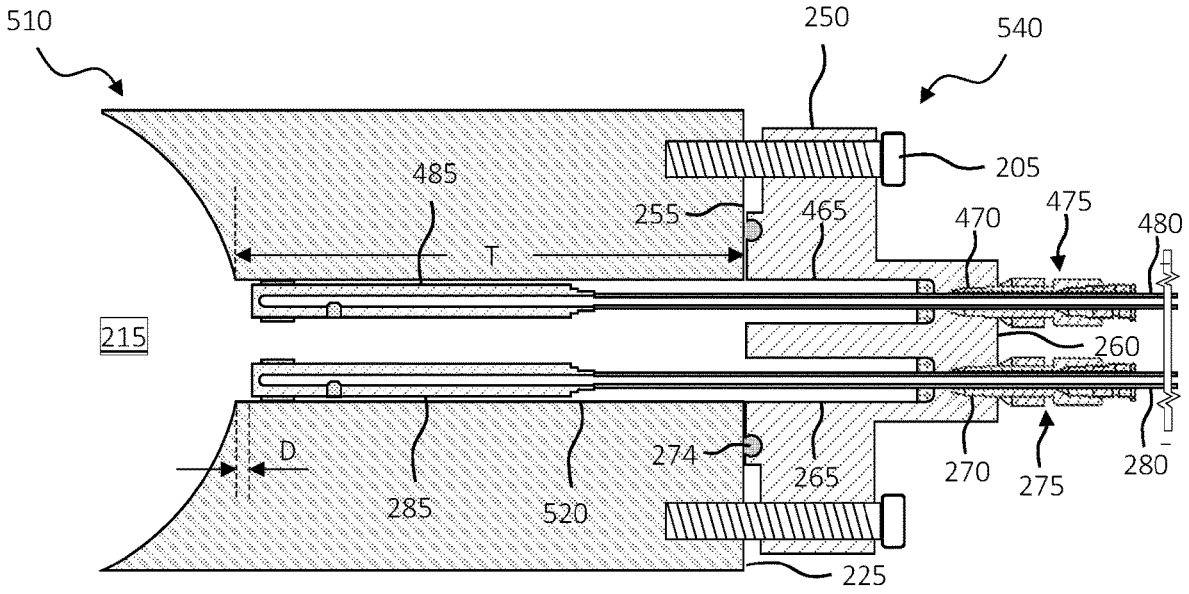
FIG. 5 illustrates an alternative embodiment of wellhead and sensor assembly designed, manufactured and operated according to another embodiment of the disclosure.

Turning to FIG. 5, illustrated is an alternative embodiment of wellhead 510 and sensor assembly 540 designed, manufactured and operated according to another embodiment of the disclosure. The wellhead 510 and the sensor assembly 540 illustrated in FIG. 5 are similar in many respect to the wellhead 410 and the sensor assembly 440 illustrated and described with respect to FIG. 4. Accordingly, like reference numbers have been used to indicate similar, if not identical, features. The wellhead 510 differs, for the most part, from the wellhead 410, in that the wellhead 510 includes only a single sensor receptacle 520.

Figure 6:
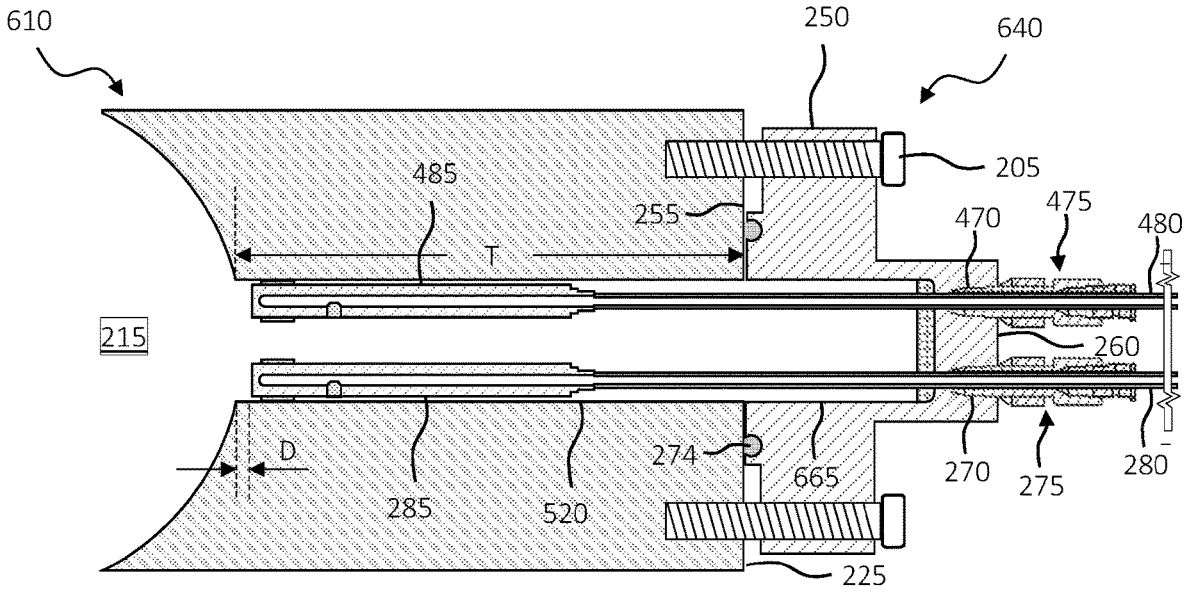
FIG. 6 illustrates an alternative embodiment of wellhead and sensor assembly designed, manufactured and operated according to another embodiment of the disclosure.

Turning to FIG. 6, illustrated is an alternative embodiment of wellhead 610 and sensor assembly 640 designed, manufactured and operated according to another embodiment of the disclosure. The wellhead 610 and the sensor assembly 640 illustrated in FIG. 6 are similar in many respect to the wellhead 510 and the sensor assembly 540 illustrated and described with respect to FIG. 5. Accordingly, like reference numbers have been used to indicate similar, if not identical, features. The sensor assembly 640 differs, for the most part, from the sensor assembly 540, in that the sensor assembly 640 includes only a single interior cavity 665.

Figure 7:
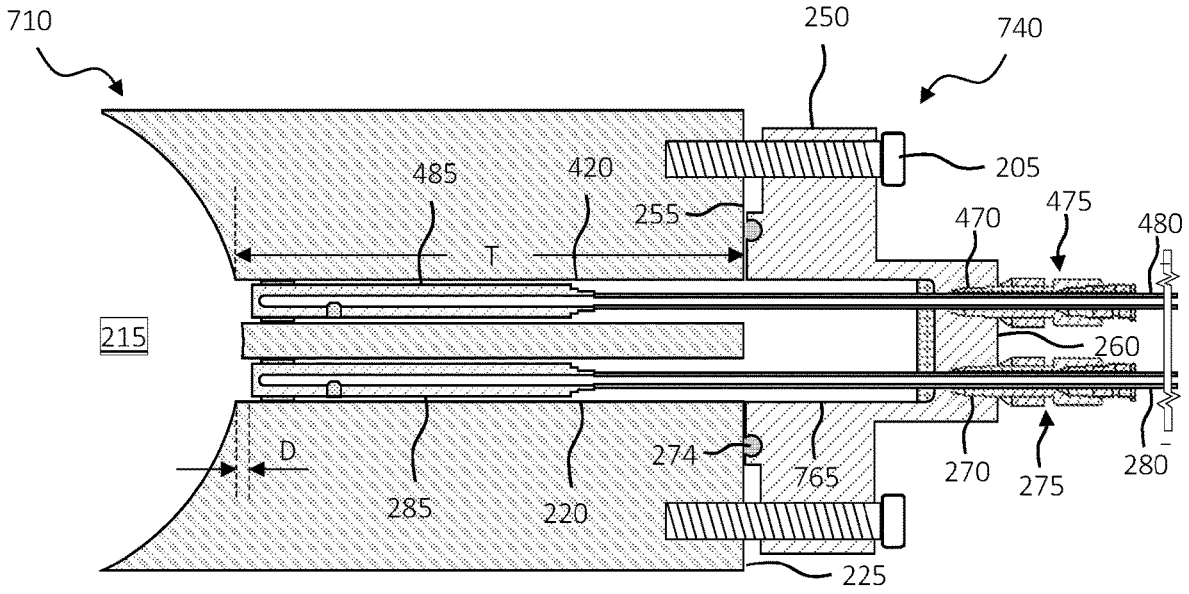
FIG. 7 illustrates an alternative embodiment of wellhead and sensor assembly designed, manufactured and operated according to another embodiment of the disclosure.

Turning to FIG. 7, illustrated is an alternative embodiment of wellhead 710 and sensor assembly 740 designed, manufactured and operated according to another embodiment of the disclosure. The wellhead 710 and the sensor assembly 740 illustrated in FIG. 7 are similar in many respect to the wellhead 410 and the sensor assembly 440 illustrated and described with respect to FIG. 4. Accordingly, like reference numbers have been used to indicate similar, if not identical, features. The sensor assembly 740 differs, for the most part, from the sensor assembly 440, in that the sensor assembly 740 includes only a single interior cavity 765.

Aspects disclosed herein include:

A. A sensor assembly, the sensor assembly including: 1) a flange housing, the flange housing including; a) a mating surface for engaging a wellhead and an opposing surface; b) an interior cavity extending into the flange housing from the mating surface; and c) an exterior cavity extending into the flange housing from the opposing surface; 2) a connector in sealed engagement with the flange housing proximate the exterior cavity; 3) a control line extending through the connector and into the interior cavity; and 4) a sensor coupled to the control line proximate the interior cavity, the control line slidable within the connector, the exterior cavity and the interior cavity to move the sensor between a retracted position and an expanded position to accommodate different thickness wellheads or flange housings.

B. A method for measuring one or more properties of wellbore fluid exiting a wellbore, the method including: providing a sensor assembly, the sensor assembly including: 1) a flange housing, the flange housing including; a) a mating surface for engaging a wellhead and an opposing surface; b) an interior cavity extending into the flange housing from the mating surface; and c) an exterior cavity extending into the flange housing from the opposing surface; 2) a connector in sealed engagement with the flange housing proximate the exterior cavity; 3) a control line extending through the connector and into the interior cavity; and 4) a sensor coupled to the control line proximate the interior cavity; and sliding the control line within the connector, the exterior cavity and the interior cavity to move the sensor between a retracted position and an expanded position to accommodate different thickness wellheads or flange housings.

C. A well system, the well system including: 1) a wellbore extending into a subterranean formation; 2) a wellhead positioned at an uphole end of the wellbore, the wellhead including a flow passageway extending there through, an exterior wall, and a sensor receptacle therein; 3) a sensor assembly coupled to the wellhead, the sensor assembly including; a) a flange housing, the flange housing including; i) a mating surface for engaging the wellhead and an opposing surface; ii) an interior cavity extending into the flange housing from the mating surface; and iii) an exterior cavity extending into the flange housing from the opposing surface; b) a connector in sealed engagement with the flange housing proximate the exterior cavity; c) a control line extending through the connector and into the interior cavity; and d) a sensor coupled to the control line proximate the interior cavity and extending into the sensor receptacle in the wellhead, the control line slidable within the connector, the exterior cavity and the interior cavity to move the sensor between a retracted position and an expanded position to accommodate a different thickness of the wellheads or flange housings.

Aspects A, B, and C may have one or more of the following additional elements in combination: Element 1: further including a seal member surrounding the control line, the seal member configured to prevent high-pressure leakage paths along the control line while allowing the control line to slide within the connector, the exterior cavity and the interior cavity. Element 2: wherein the seal member forms at least a portion of the connector. Element 3: wherein the seal member is located within the exterior cavity. Element 4: wherein the seal member is located within the interior cavity. Element 5: wherein the control line is a tubing encapsulated conductor. Element 6: wherein the sensor is a temperature sensor or a pressure sensor. Element 7: wherein the exterior cavity is a first exterior cavity, the connector is a first connector, the control line is first control line and the sensor is a first sensor, and further wherein the flange housing includes a second exterior cavity extending into the flange housing from the opposing surface, and further including: a second connector in sealed engagement with the flange housing proximate the second exterior cavity; a second control line extending through the second connector and into the interior cavity; and a second sensor coupled to the second control line proximate the interior cavity, the second control line slidable within the second connector, the second exterior cavity and the interior cavity to move the second sensor between a second retracted position and a second expanded position to accommodate different thickness wellheads or flange housings. Element 8: wherein the interior cavity is a first interior cavity, the exterior cavity is a first exterior cavity, the connector is a first connector, the control line is first control line and the sensor is a first sensor, and further wherein the flange housing includes a second interior cavity extending into the flange housing from the mating surface and a second exterior cavity extending into the flange housing from the opposing surface, and further including: a second connector in sealed engagement with the flange housing proximate the second exterior cavity; a second control line extending through the second connector and into the second interior cavity; and a second sensor coupled to the second control line proximate the second interior cavity, the second control line slidable within the second connector, the second exterior cavity and the second interior cavity to move the second sensor between a second retracted position and a second expanded position to accommodate different thickness wellheads or flange housings. Element 9: further including attaching the flange housing of the sensor assembly to a wellhead, the wellhead including a sensor receptacle extending between a flow passageway and an exterior wall thereof for accepting the sensor. Element 10: wherein the attaching occurs prior to the sliding. Element 11: wherein the attaching occurs after the sliding. Element 12: wherein the flange housing further includes a seal groove in the mating surface, the seal groove circumscribing the interior cavity, and a circumferential seal located in the seal groove, and further wherein attaching the flange housing to the wellhead includes attaching the flange housing to the wellhead with fasteners that compress the circumferential seal against the exterior wall of the wellhead to form a seal between the flange housing and the wellhead. Element 13: wherein the sensor assembly further includes a seal member surrounding the control line, the seal member configured to prevent high-pressure leakage paths along the control line while allowing the control line to slide within the connector, the exterior cavity and the interior cavity. Element 14: wherein the interior cavity is a first interior cavity, the exterior cavity is a first exterior cavity, the connector is a first connector, the control line is first control line and the sensor is a first sensor, and further wherein the flange housing includes a second interior cavity extending into the flange housing from the mating surface and a second exterior cavity extending into the flange housing from the opposing surface, and further including: a second connector in sealed engagement with the flange housing proximate the second exterior cavity; a second control line extending through the second connector and into the second interior cavity; and a second sensor coupled to the second control line proximate the second interior cavity and extending into the sensor receptacle in the wellhead, the second control line slidable within the second connector, the second exterior cavity and the second interior cavity to move the second sensor between a second retracted position and a second expanded position to accommodate different thickness wellheads or flange housings. Element 15: wherein the exterior cavity is a first exterior cavity, the connector is a first connector, the control line is first control line and the sensor is a first sensor, and further wherein the flange housing includes a second exterior cavity extending into the flange housing from the opposing surface, and further including: a second connector in sealed engagement with the flange housing proximate the second exterior cavity; a second control line extending through the second connector and into the interior cavity; and a second sensor coupled to the second control line proximate the interior cavity and extending into the sensor receptacle in the wellhead, the second control line slidable within the second connector, the second exterior cavity and the interior cavity to move the second sensor between a second retracted position and a second expanded position to accommodate different thickness wellheads or flange housings. Element 16: wherein the exterior cavity is a first exterior cavity, the connector is a first connector, the control line is first control line and the sensor is a first sensor, and further wherein the flange housing includes a second exterior cavity extending into the flange housing from the opposing surface, and further including: a second connector in sealed engagement with the flange housing proximate the second exterior cavity; a second control line extending through the second connector and into the interior cavity; and a second sensor coupled to the second control line proximate the interior cavity and extending into a second sensor receptacle in the wellhead, the second control line slidable within the second connector, the second exterior cavity and the interior cavity to move the second sensor between a second retracted position and a second expanded position to accommodate different thickness wellheads or flange housings. Element 17: wherein the interior cavity is a first interior cavity, the exterior cavity is a first exterior cavity, the connector is a first connector, the control line is first control line and the sensor is a first sensor, and further wherein the flange housing includes a second interior cavity extending into the flange housing from the mating surface and a second exterior cavity extending into the flange housing from the opposing surface, and further including: a second connector in sealed engagement with the flange housing proximate the second exterior cavity; a second control line extending into the second interior cavity through the second connector; and a second sensor coupled to the second control line proximate the second interior cavity and extending into a second sensor receptacle in the wellhead, the second control line slidable within the second connector, the second exterior cavity and the second interior cavity to move the second sensor between a second retracted position and a second expanded position to accommodate the different thickness of the wellheads or flange housings.

Those skilled in the art to which this application relates will appreciate that other and further additions, deletions, substitutions and modifications may be made to the described embodiments.

What is claimed is:

1. A sensor assembly, comprising:

a flange housing, the flange housing including;

a mating surface for engaging a wellhead and an opposing surface;

an interior cavity extending into the flange housing from the mating surface; and an exterior cavity extending into the flange housing from the opposing surface;

a connector in sealed engagement with the flange housing proximate the exterior cavity;

a control line extending through the connector and into the interior cavity; and a sensor coupled to the control line proximate the interior cavity, the control line slidable within the connector, the exterior cavity and the interior cavity while the connector is in sealed engagement with the flange housing to move the sensor between a retracted position and an expanded position to accommodate different thickness wellheads or flange housings.

2. The sensor assembly as recited in claim 1, further including a seal member surrounding the control line, the seal member configured to prevent high-pressure leakage paths along the control line while allowing the control line to slide within the connector, the exterior cavity and the interior cavity.

3. The sensor assembly as recited in claim 2, wherein the seal member forms at least a portion of the connector.

4. The sensor assembly as recited in claim 2, wherein the seal member is located within the exterior cavity.

5. The sensor assembly as recited in claim 2, wherein the seal member is located within the interior cavity.

6. The sensor assembly as recited in claim 1, wherein the control line is a tubing encapsulated conductor.

7. The sensor assembly as recited in claim 1, wherein the sensor is a temperature sensor or a pressure sensor.

8. The sensor assembly as recited in claim 1, wherein the exterior cavity is a first exterior cavity, the connector is a first connector, the control line is first control line and the sensor is a first sensor, and further wherein the flange housing includes a second exterior cavity extending into the flange housing from the opposing surface, and further including:

a second connector in sealed engagement with the flange housing proximate the second exterior cavity;

a second control line extending through the second connector and into the interior cavity; and a second sensor coupled to the second control line proximate the interior cavity, the second control line slidable within the second connector, the second exterior cavity and the interior cavity to move the second sensor between a second retracted position and a second expanded position to accommodate different thickness wellheads or flange housings.

9. The sensor assembly as recited in claim 1, wherein the interior cavity is a first interior cavity, the exterior cavity is a first exterior cavity, the connector is a first connector, the control line is first control line and the sensor is a first sensor, and further wherein the flange housing includes a second interior cavity extending into the flange housing from the mating surface and a second exterior cavity extending into the flange housing from the opposing surface, and further including:

a second connector in sealed engagement with the flange housing proximate the second exterior cavity;

a second control line extending through the second connector and into the second interior cavity; and a second sensor coupled to the second control line proximate the second interior cavity, the second control line slidable within the second connector, the second exterior cavity and the second interior cavity to move the second sensor between a second retracted position and a second expanded position to accommodate different thickness wellheads or flange housings.

10. A method for measuring one or more properties of wellbore fluid exiting a wellbore, the method comprising:

providing a sensor assembly, the sensor assembly including:

a flange housing, the flange housing including;

a mating surface for engaging a wellhead and an opposing surface;

an interior cavity extending into the flange housing from the mating surface; and an exterior cavity extending into the flange housing from the opposing surface;

a connector in sealed engagement with the flange housing proximate the exterior cavity;

a control line extending through the connector and into the interior cavity; and a sensor coupled to the control line proximate the interior cavity; and sliding the control line within the connector, the exterior cavity and the interior cavity while the connector is in sealed engagement with the flange housing to move the sensor between a retracted position and an expanded position to accommodate different thickness wellheads or flange housings.

11. The method as recited in claim 10, further including attaching the flange housing of the sensor assembly to a wellhead, the wellhead including a sensor receptacle extending between a flow passageway and an exterior wall thereof for accepting the sensor.

12. The method as recited in claim 11, wherein the attaching occurs prior to the sliding.

13. The method as recited in claim 11, wherein the attaching occurs after the sliding.

14. The method as recited in claim 11, wherein the flange housing further includes a seal groove in the mating surface, the seal groove circumscribing the interior cavity, and a circumferential seal located in the seal groove, and further wherein attaching the flange housing to the wellhead includes attaching the flange housing to the wellhead with fasteners that compress the circumferential seal against the exterior wall of the wellhead to form a seal between the flange housing and the wellhead.

15. A well system, comprising:

a wellbore extending into a subterranean formation;

a wellhead positioned at an uphole end of the wellbore, the wellhead including a flow passageway extending there through, an exterior wall, and a sensor receptacle therein;

a sensor assembly coupled to the wellhead, the sensor assembly including;

a flange housing, the flange housing including;

a mating surface for engaging the wellhead and an opposing surface;

an interior cavity extending into the flange housing from the mating surface; and an exterior cavity extending into the flange housing from the opposing surface;

a connector in sealed engagement with the flange housing proximate the exterior cavity;

a control line extending through the connector and into the interior cavity; and a sensor coupled to the control line proximate the interior cavity and extending into the sensor receptacle in the wellhead, the control line slidable within the connector, the exterior cavity and the interior cavity while the connector is in sealed engagement with the flange housing to move the sensor between a retracted position and an expanded position to accommodate a different thickness of the wellheads or flange housings.

16. The well system as recited in claim 15, wherein the sensor assembly further includes a seal member surrounding the control line, the seal member configured to prevent high-pressure leakage paths along the control line while allowing the control line to slide within the connector, the exterior cavity and the interior cavity.

17. The well system as recited in claim 15, wherein the interior cavity is a first interior cavity, the exterior cavity is a first exterior cavity, the connector is a first connector, the control line is first control line and the sensor is a first sensor, and further wherein the flange housing includes a second interior cavity extending into the flange housing from the mating surface and a second exterior cavity extending into the flange housing from the opposing surface, and further including:

a second connector in sealed engagement with the flange housing proximate the second exterior cavity;

a second control line extending through the second connector and into the second interior cavity; and a second sensor coupled to the second control line proximate the second interior cavity and extending into the sensor receptacle in the wellhead, the second control line slidable within the second connector, the second exterior cavity and the second interior cavity to move the second sensor between a second retracted position and a second expanded position to accommodate different thickness wellheads or flange housings.

18. The well system as recited in claim 15, wherein the exterior cavity is a first exterior cavity, the connector is a first connector, the control line is first control line and the sensor is a first sensor, and further wherein the flange housing includes a second exterior cavity extending into the flange housing from the opposing surface, and further including:

a second connector in sealed engagement with the flange housing proximate the second exterior cavity;

a second control line extending through the second connector and into the interior cavity; and a second sensor coupled to the second control line proximate the interior cavity and extending into the sensor receptacle in the wellhead, the second control line slidable within the second connector, the second exterior cavity and the interior cavity to move the second sensor between a second retracted position and a second expanded position to accommodate different thickness wellheads or flange housings.

19. The well system as recited in claim 15, wherein the exterior cavity is a first exterior cavity, the connector is a first connector, the control line is first control line and the sensor is a first sensor, and further wherein the flange housing includes a second exterior cavity extending into the flange housing from the opposing surface, and further including:

a second connector in sealed engagement with the flange housing proximate the second exterior cavity;

a second control line extending through the second connector and into the interior cavity; and a second sensor coupled to the second control line proximate the interior cavity and extending into a second sensor receptacle in the wellhead, the second control line slidable within the second connector, the second exterior cavity and the interior cavity to move the second sensor between a second retracted position and a second expanded position to accommodate different thickness wellheads or flange housings.

20. The well system as recited in claim 15, wherein the interior cavity is a first interior cavity, the exterior cavity is a first exterior cavity, the connector is a first connector, the control line is first control line and the sensor is a first sensor, and further wherein the flange housing includes a second interior cavity extending into the flange housing from the mating surface and a second exterior cavity extending into the flange housing from the opposing surface, and further including:

a second connector in sealed engagement with the flange housing proximate the second exterior cavity;

a second control line extending into the second interior cavity through the second connector; and a second sensor coupled to the second control line proximate the second interior cavity and extending into a second sensor receptacle in the wellhead, the second control line slidable within the second connector, the second exterior cavity and the second interior cavity to move the second sensor between a second retracted position and a second expanded position to accommodate the different thickness of the wellheads or flange housings.

* * * * *